US009427100B1

(12) United States Patent
Coyle

(10) Patent No.: US 9,427,100 B1
(45) Date of Patent: Aug. 30, 2016

(54) MULTIPURPOSE PLATE

(71) Applicant: George Coyle, Branford, CT (US)

(72) Inventor: George Coyle, Branford, CT (US)

( * ) Notice: Subject to any disclaimer, the term of this patent is extended or adjusted under 35 U.S.C. 154(b) by 25 days.

(21) Appl. No.: 14/301,652

(22) Filed: Jun. 11, 2014

Related U.S. Application Data

(63) Continuation of application No. 29/458,818, filed on Jun. 24, 2013, now Pat. No. Des. 708,904.

(60) Provisional application No. 61/833,570, filed on Jun. 11, 2013.

(51) Int. Cl.

| | |
|---|---|
| ***B65D 25/30*** | (2006.01) |
| ***B65D 6/40*** | (2006.01) |
| ***B65D 90/22*** | (2006.01) |
| ***A47G 19/06*** | (2006.01) |
| ***A47G 19/02*** | (2006.01) |
| ***A47G 19/00*** | (2006.01) |
| ***A47G 23/02*** | (2006.01) |
| ***A47G 23/06*** | (2006.01) |

(52) U.S. Cl.
CPC ..... *A47G 23/06* (2013.01); *B65D 25/30* (2013.01)

(58) Field of Classification Search
CPC .... B65D 25/30; A47G 19/06; A47G 19/065; A47G 23/0225; A47G 23/0625
USPC ..... 220/575, 737, DIG. 13
See application file for complete search history.

(56) References Cited

U.S. PATENT DOCUMENTS

| | | | | |
|---|---|---|---|---|
| D159,643 | S | 8/1950 | Kelley et al. | |
| 2,920,804 | A * | 1/1960 | Minton | 229/400 |
| D218,843 | S | 9/1970 | Smith | |
| D227,230 | S | 6/1973 | Stamper | |
| 4,607,758 | A * | 8/1986 | Stevens | 220/23.83 |
| D351,316 | S | 10/1994 | Mann | |
| D358,739 | S | 5/1995 | Brown et al. | |
| 5,429,266 | A * | 7/1995 | D'Oliveira et al. | 220/556 |
| 5,490,653 | A * | 2/1996 | Ingwersen | 248/311.2 |
| D384,248 | S | 9/1997 | Cooley | |
| D473,427 | S | 4/2003 | Kleckauskas et al. | |
| 7,337,943 | B2 * | 3/2008 | Johns et al. | 229/406 |
| D586,527 | S | 2/2009 | Perkins | |
| D672,201 | S | 12/2012 | Jowett | |
| 2010/0064899 | A1 | 3/2010 | Aardenburg | |

* cited by examiner

*Primary Examiner* — Fenn Mathew
*Assistant Examiner* — Andrew T Kirsch
(74) *Attorney, Agent, or Firm* — DeLio, Peterson & Curcio, LLC; Kelly M. Nowak

(57) ABSTRACT

Multipurpose plates and method of use thereof. The plates include a rigid bottom layer having regions for holding food, hand receiving portions, first object holding portion for holding a drinking vessel, a second object holding portion having a slit for holding an eating related item, and a recessed receiving portion on the rigid layer for receiving a container. A user's hand holds the plate at one of the hand receiving portions, while a beverage vessel is inserted and held in the first object holding portion and one or more eating related items is inserted and held by the slit of the second object holding portion. The plate with its first and second object holding portions allow the user to securely eat food off the plate while the beverage vessel and the one or more eating related items are held by the plate.

19 Claims, 8 Drawing Sheets

MULTIPURPOSE PLATE

This application is a non-provisional application of and claims priority to provisional application Ser. No. 61/833,570 filed Jun. 11, 2013 and also claims priority to Design patent application no. 29/458,818 filed Jun. 24, 2013, both of which are hereby incorporated by reference in their entireties.

BACKGROUND OF THE INVENTION

1. Field of the Invention

The present invention is directed to plates, and in particular, to multi-purpose eating plates and methods of using the same.

2. Description of Related Art

A number of plates for holding food exist in the market. Plates are generally of a rigid material and hold food at the center thereof. However, when an end user is holding a plate with food on it, as well as holding other eating related items, such as, a beverage, fork, knife, spoon, napkin, etc., it is very difficult and burdensome to hold all such items while simultaneously eating the food off the plate. In most instances, the end user cannot hold all such items, and may need to rest his beverage on a table, or even place his napkin in his pocket. When an end user holds several items in his hand, including a plate, the end user may lose grip of such items resulting in one or more of the items being dropped and/or even the plate or a drinking vessel being dropped.

Accordingly, a need exists in the art for plates that allow an end user to easily and efficiently eat food off the plate while also holding one or more other eating related objects in his hand(s).

SUMMARY OF THE INVENTION

Bearing in mind the problems and deficiencies of the prior art, it is therefore an object of the present invention to provide a multipurpose plate that includes a rigid bottom layer having regions for holding food, a first hand receiving portion for holding the plate, an opening for holding a drinking vessel, a gap for holding an eating related item, and a recessed receiving portion on a surface of the rigid bottom layer for receiving a container. The container may be a cup, can, bowl, dish, glass, mug, tray or a paper receptacle. The eating related item may be a fork, knife, spoon, napkin, toothpick or combinations thereof. In certain embodiments the plate may also include a raised retaining structure for holding the container within the recessed receiving portion.

In other aspects, the plate is also directed to other multipurpose plates. These multipurpose plates include a rigid bottom layer having regions for holding food, and first and second tiered hand receiving portions for right-hand or left-hand holding the plate. The plates may also include a thumb receiving portion adjacent the first and second tiered hand receiving portions for resting a user's thumb, a first object holding portion for holding an eating related item, and a second object holding portion having a slit for holding another eating related item. The plates may further include recessed receiving portion on a surface of the rigid bottom layer for receiving a container.

In still other embodiments, the invention is directed to methods of using a multipurpose plate. The plates may include a rigid bottom layer having regions for holding food, first and second tiered hand receiving portions, a thumb receiving portion adjacent the first and second tiered hand receiving portions, first and second object holding portions, the second object holding portion having a slit therein, and a recessed receiving portion on a surface of the rigid bottom layer for receiving a container. A user's hand holds the plate at the first or second tiered hand receiving portions whereby the user's thumb rests in the thumb receiving portion. The user inserts a beverage vessel into the first object holding portion, and the first object holding portion holding such beverage vessel therein. The user also inserts one or more eating related items into the slit of the second object holding portion, and the second object holding portion holding such one or more eating related items therein. In use, the first and second object holding portions allow the user to securely eat food off the plate while the beverage vessel and the one or more eating related items are held by the plate.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-10 of the drawings in which like numerals refer to like features of the invention.

The present invention is directed to multipurpose plates that allow an end user to easily hold the plate in one hand, and allow the other hand to remain substantially free for use to eat food off the plate. This other hand is allowed to hold a utensil for eating or simply used alone to eat food off the plate using the user's fingers. The plates of the invention shown in FIGS. 1-10 have various recessed portions or impressions for holding a food item in combination with other object receiving portions that allow the end user to easily hold other objects while eating food off the plate.

Figure 1:
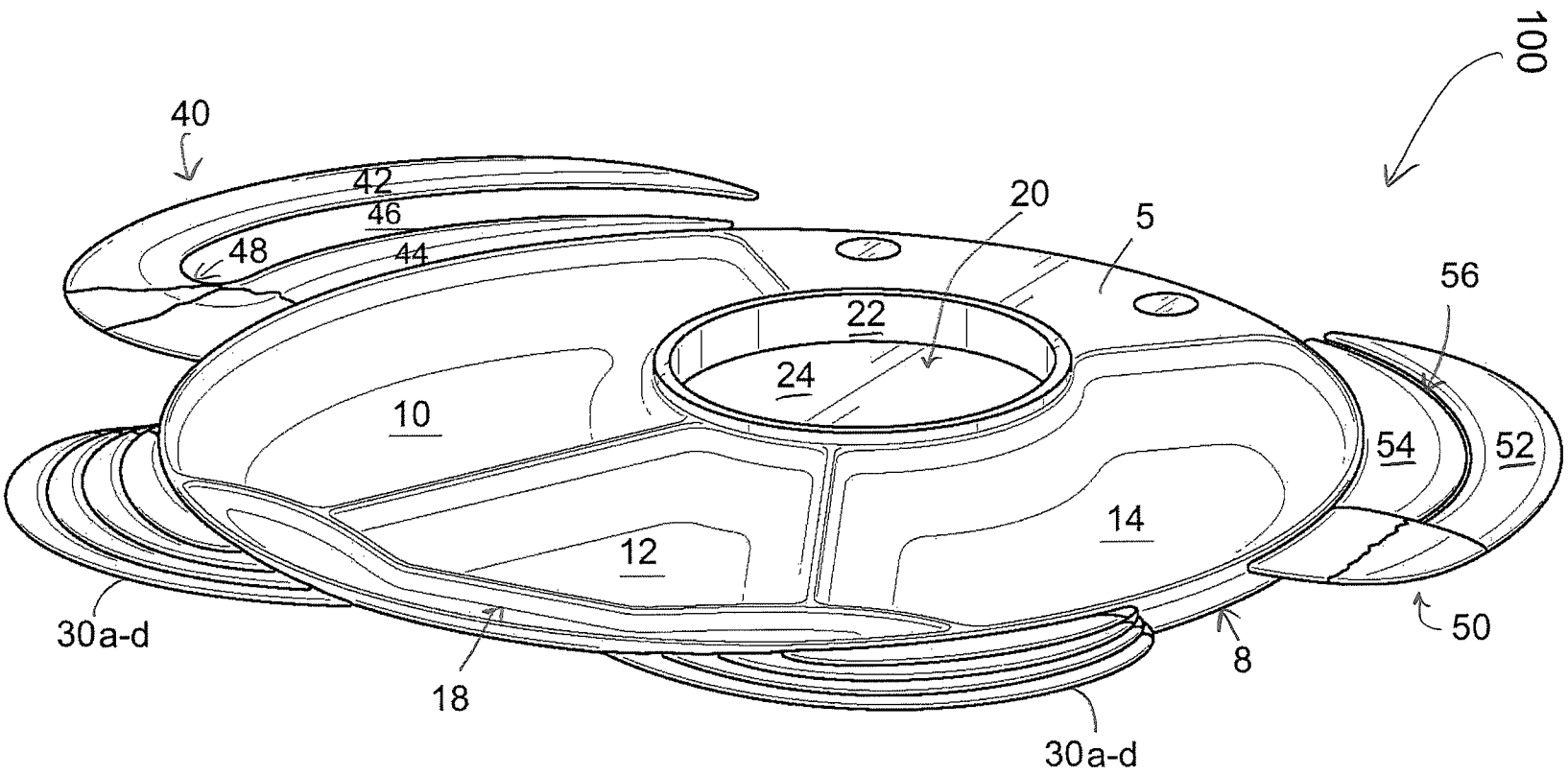
FIG. 1 is a front perspective view of a multipurpose plate in accordance with one or more embodiments of the invention.
Figure 2:
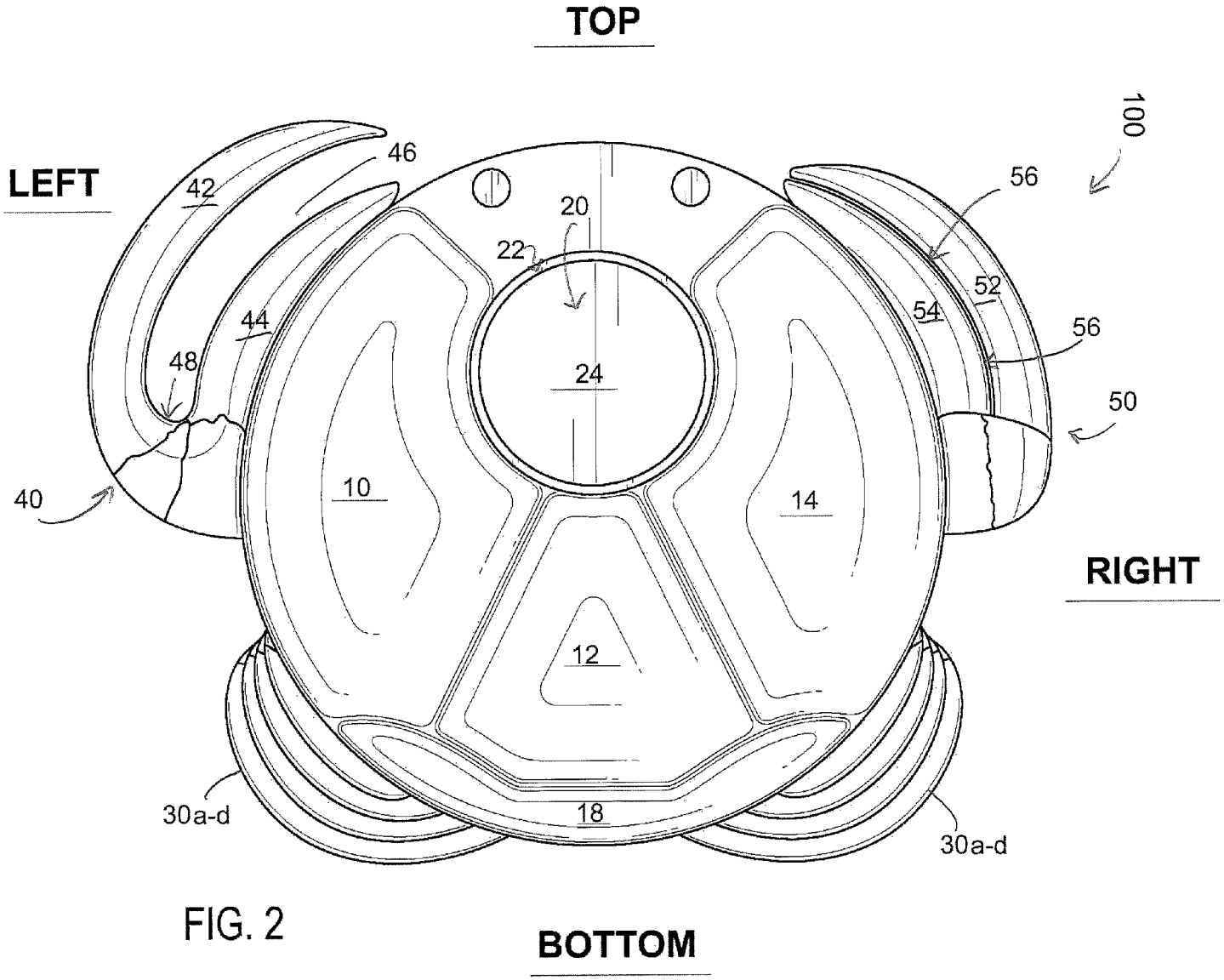
FIG. 2 is a front view of the multipurpose plate of FIG. 1.
Figure 3:
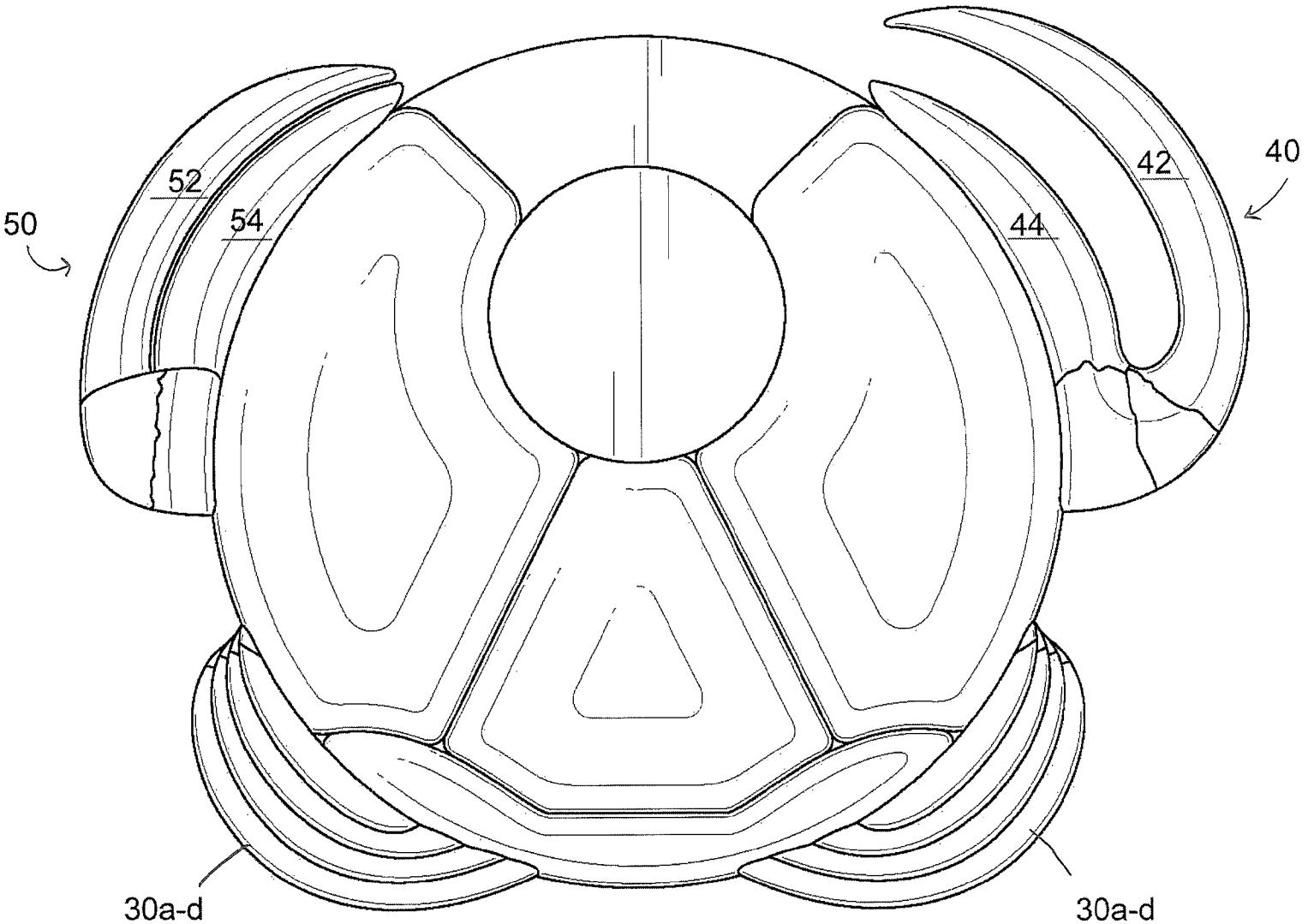
FIG. 3 is a rear view of the multipurpose plate of FIG. 1.
Figure 5:
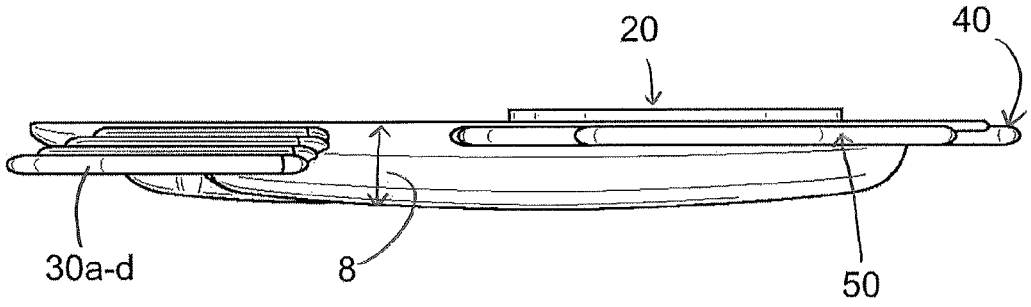
FIG. 5 is a right side view of the multipurpose plate of FIG. 1.
Figure 4:
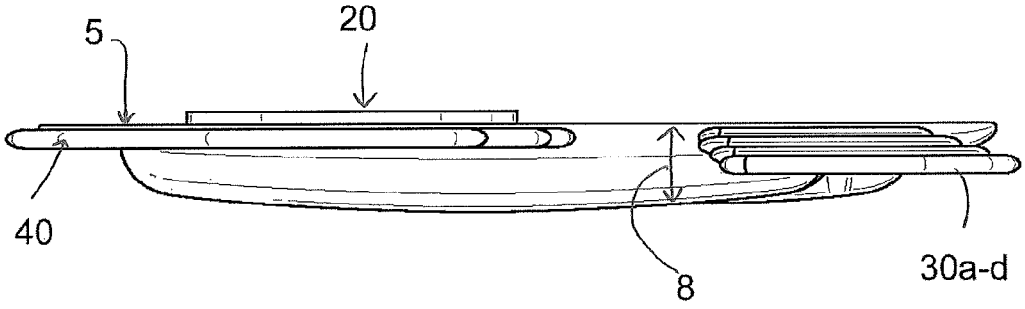
FIG. 4 is a left side view of the multipurpose plate of FIG. 1.
Figure 6:
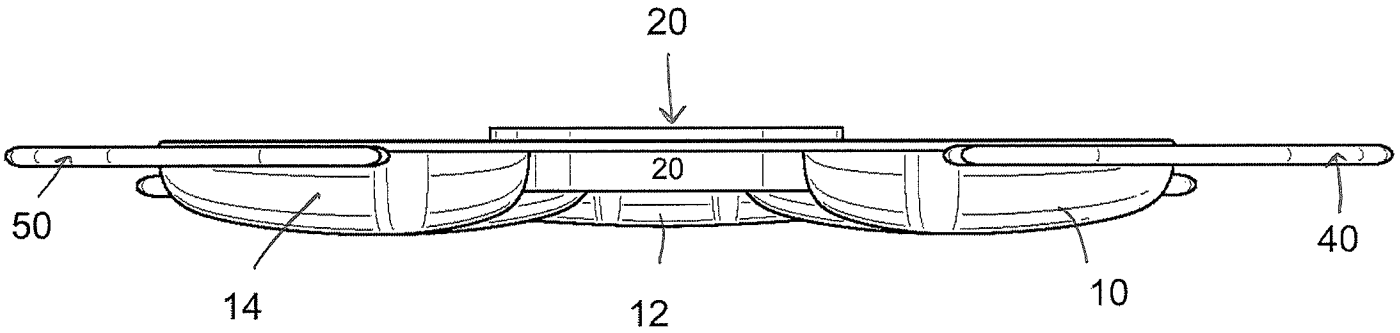
FIG. 6 is a top side view of the multipurpose plate of FIG. 1.
Figure 7:
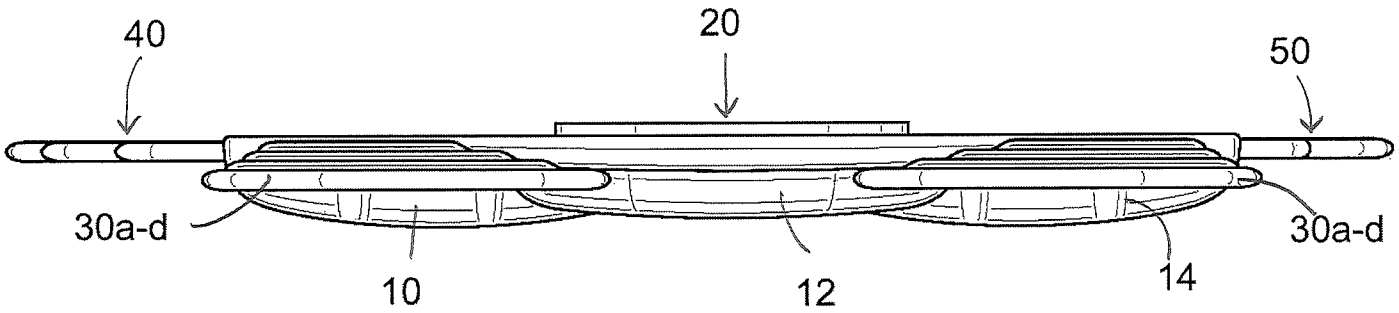
FIG. 7 is a bottom side view of the multipurpose plate of FIG. 1.
Figure 8:
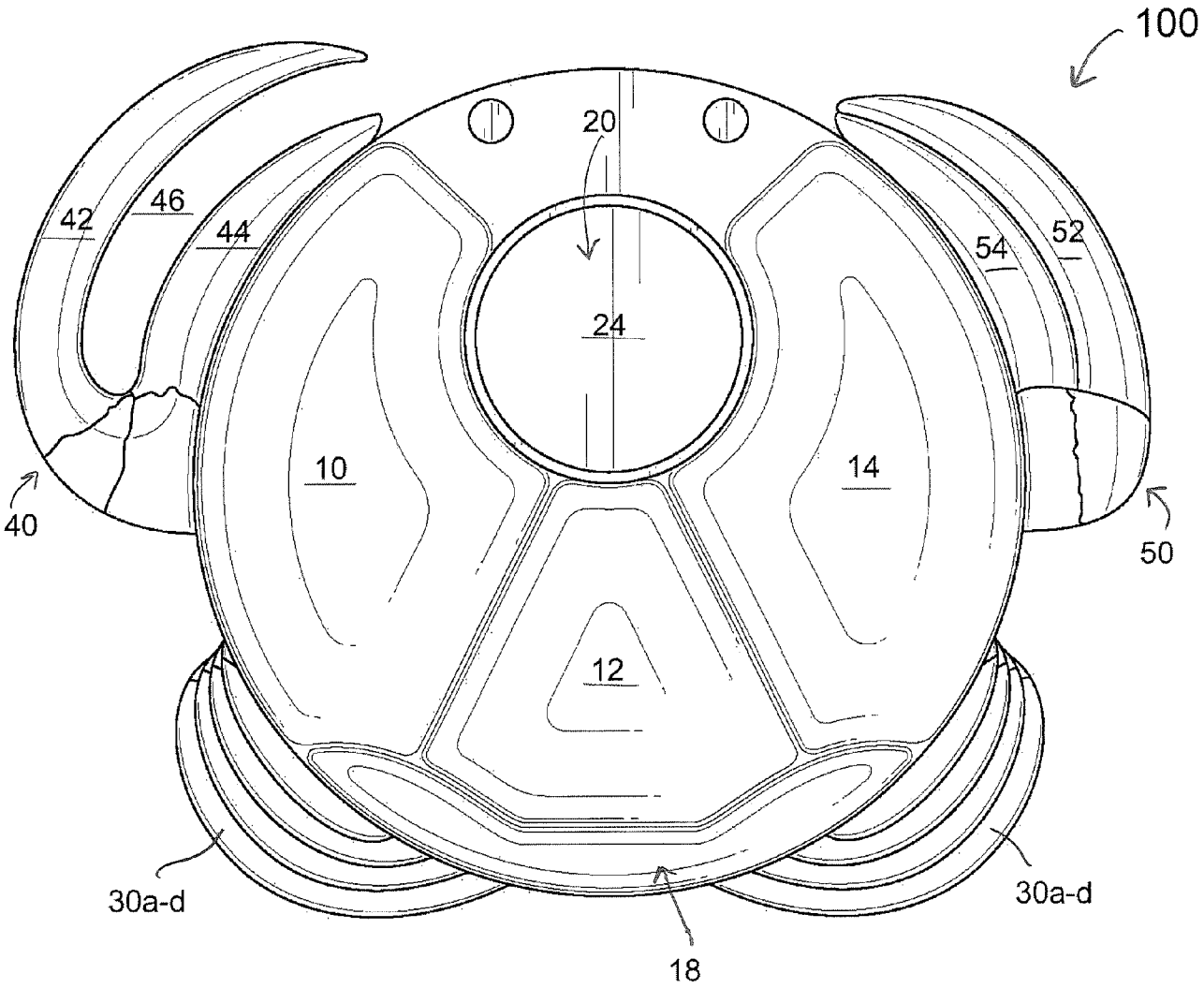
FIG. 8 is a front view of another multipurpose plate in accordance with various embodiments of the invention.

Referring to FIGS. 1-7, a multipurpose plate is shown in accordance with one or more embodiments of the invention. The multipurpose plate 100 includes a front surface as shown in FIGS. 1-2, and a back surface as shown in FIG. 3.

In one or more embodiments, the plate 100 is comprised of a rigid material that provides the plate with strength. These rigid materials may include, but are not limited to, ceramic, glass, china, porcelain, stoneware, plastic, metal, wood, cardboard, thick paper pulp, paper, foam materials, organic materials, and the like. It should be appreciated that the plates 100 of the invention may have any shape and size, and may include several variations of components of the invention as described herein. For ease of understanding the invention, and not meant to limit the invention in any manner, the plate in FIGS. 1-10 is shown and described as a plate shaped as a crab.

In accordance with the different embodiments, the plates 100 may include any number of recessed portions or impressions, such as recessed portions 10, 12 and 14, for holding and retaining one or more food items for consumption. The food retaining recessed portions may extend across the plane of the plate 100 and may extend a depth substantially equivalent to a thickness 8 of the plate 100.

The plates 100 of the invention may also include one or more multipurpose recessed portion 20 that has a shape and depth capable of holding various different components. The recessed portion 20 has a bottom planar surface 24 and sidewalls 22, and may reside at any location across the surface of the plate 100. In one or more embodiments the recessed portion 20 may be suitable for holding and retaining dip, condiment(s), sauces, puddings, ice cream and any other liquidous and/or semi-liquidous food products or materials. In certain embodiments the recessed portion 20 has sidewalls 22 of a sufficient height, thickness and rigidity to holding and retain a beverage container such as, for instance, a cup, can, bottle, mug, glass, stemmed glass (e.g., a wine glass), bowl, dish, tray and paper receptacle, and the like. As shown in the side view left, right, top and bottom views of FIGS. 4-7, respectively, the recessed portion 20 may reside a predetermined distance above the top planar surface area 5 of the plate 100.

Figure 9:
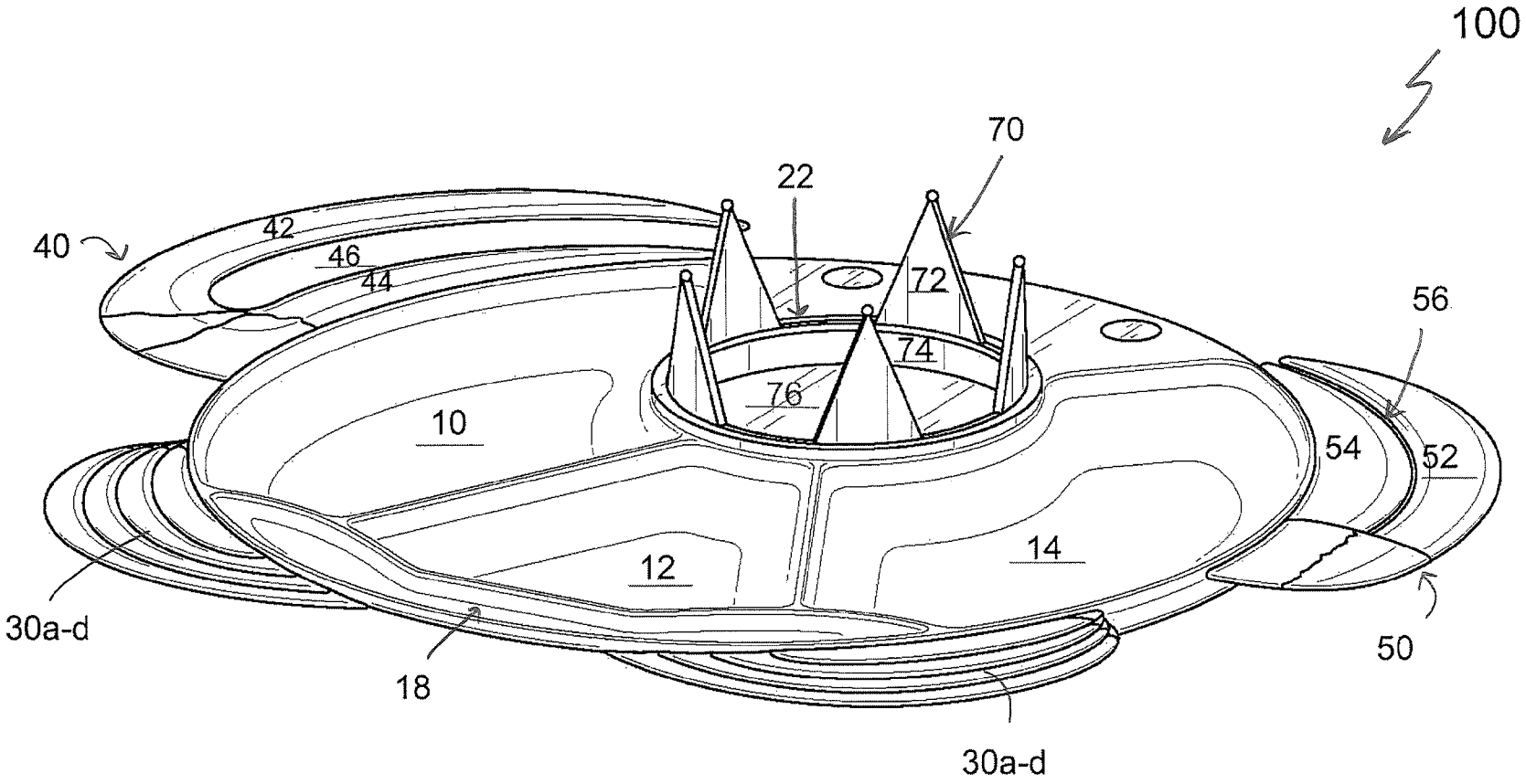
FIG. 9 is a front perspective view of still another multipurpose plate in accordance with various embodiments of the invention.

Referring to FIG. 9, a raised retaining structure 70 may be used in combination with the plate 100. The retaining structure 70 may be an insert that fits snugly into the recessed portion 20 to help secure the beverage container on top of the plate 100. The retaining structure 70 may have any design and preferably has a lower portion shape and size that allows the insert retaining structure 70 to be secured within the recessed portion 20.

For instance, in those embodiments wherein the sidewalls 22 and planar bottom surface 23 are in circular or dish-like shapes, then the bottom of the retaining structure 70 likewise has sidewalls 74 and a bottom surface 76 each in a shape and size corresponding to the mating surface of the sidewalls 22 and bottom surface 23, respectively (i.e., in circular or dish-like shapes). In this manner, the retaining structure 70 may be secured within the recessed portion 20. In certain embodiments, the sidewalls 22 and outer surface area of sidewalls 74 (i.e. the outside surface area of the bottom portion of the retaining structure 70) may have interlocking surface areas that allow the retaining structure 70 to be affixed to and within the recessed portion 20. For instance, the sidewalls 22 inside recessed portion 20 may have ridges, circumferential ribs, grooves, bevels, and the like that mate and interlock with counterpart ridges, circumferential ribs, grooves, bevels, and the like on the outside surface area of the retaining structure 70 sidewalls 22. This may allow the retaining structure 70 and recessed portion 20 to be securely affixed and adjoined to one another via a snap fit, twist fit, locking action, friction fit, etc. so that the retaining structure 70 can not be easily removed from the recessed portion 20.

The raised retaining structure 70 may further include one or more raised portions 72 that surround and extend upwardly from the sidewalls 74. In certain embodiments the raised portions 72 may be a single raised structure that comprises the sidewalls 74 itself rising up from the planar surface area 5 of the plate 100. In other embodiments the raised portions 72 comprise a number of separate raised portions 72 extending upwardly from both the sidewalls 74 and the surface area 5 of the plate 100. Again, while not meant to limit the invention, as shown in the drawings wherein the plate is in the shape of a crab plate, the retaining structure 70 with its raised portions 72 may be in the shape of a crown that is capable of being removably inserted into the recessed portion 20 near the center of the crab plate. The one or more raised portion(s) 72 help to hold and secure the beverage container into the recessed portion 20 and on top of the plate 100.

In accordance with the various embodiments of the invention, the recessed receiving portion 20 provides the end user with more hands-free room on the plate. The raised retaining structure 70 may be removable or permanently attached to the plate. Further, the raised retaining structure 70 may fit inside the recessed receiving portion 20 as described above, or alternatively, it may fit above the plate and around that part of the recessed portion 20 that extends above the plate surface 5. Still further, in other embodiments, wherein the raised retaining structure 70 resides and fits inside the recessed portion 20, such raised retaining structure 70 may have a lip portion that extends over and locks onto that portion of the recessed portion 20 that extends above the plate surface 5. This lip portion of the retaining structure helps to lock and secure the retaining structure 70 to the recessed portion 20 of the plate 100.

Referring to the drawings, the plates 100 of the invention also include one or more sets of tiered levels 30*a-d* or plate holding portions that extend outward from a circumference or perimeter of the plate 100. These tiered levels 30*a-d* are composed of the plate material and help the end user hold the plate 100. In one or more embodiments, the plate(s) 100 may include numerous sets of tiered levels 30*a-d* around the outside perimeter of the plate. For instance, as shown in FIGS. 1-9, the plate 100 may be provided with a set of tiered levels 30*a-d* on the left side of the plate, and another set of tiered levels 30*a-d* on the right side of the plate. This allows either a left-handed user or a right-handed user to easily hold and utilize the plates 100 of the invention. As shown in FIGS. 4-7, the tiered levels 30*a-d* may extend down from a top surface 5 of the plate to a portion of a distance of the thickness 8 of the plate 100. Alternatively, the tiered levels 30*a-d* may extend along the full distance of the plate thickness 8, or even to a length greater than the plate thickness. While the drawings are shown with 4 (four) tiered levels, it should be appreciated that the plate 100 may have any number of tiered levels.

Adjacent these one or more tiered levels 30*a-d*, the plate may further include an indented portion 18 that allows the end user to rest his thumb therein, and even more securely grip and hold the plate. That is, the end user utilizes his fingers to hold the tiered levels 30*a-d* while the end user's thumb rests in the indented portion(s) 18 of the plate. The plate 100 may have one or more of these indented portions 18. The combination of the tiered levels 30*a-d* in conjunction with the indented portion 18 allows the end user to obtain a tight grip on the plate 100 for easily and strongly hold the plate. An end user may even use the indented portion(s) 18 to hold one or more unused eating utensil (e.g., fork, knife, spoon, etc.), or even condiments (e.g., salt, pepper, mustard, ketchup, dip, sauce, etc.)

The plates of the invention are also provided with one or more object holding portions that reside at or near the perimeter or outside portion of the plate. In one or more embodiments, the plates 100 include a first object holding portion 40 that may receive a beverage container such as, for example, a can, glass, stemmed glass (e.g., wine glass), and the like. In one of the preferred embodiments the first object holding portion 40 includes a first outwardly extending portion 44 that resides along a portion of the perimeter of the plate 100. A second outwardly extending portion 42 protrudes out from the first portion 44 and bends in a path substantially along the path of the first portion 44. Together the first and second portions 44, 42 comprise a single object holding device of the plate and form an opening 46 there between to hold such object. For instance, the stem of a stemmed wine glass may be inserted into the opening 46 until it reaches inner curve 48 such that the stem rests at the inner curve 48 and the glass portion rests on top surfaces of the first and second bent portions 42, 44 of the object holding portion 40 of plate 100.

Plates 100 of the invention may also include a second object holding portion 50 for receiving and holding one or more other food, drink and/or eating related object(s). This second object holding portion 50 may be part of the plate, within the plate circumference or an extension of the plate circumference. While not meant to limit the invention, the drawings show the second object holding portion 50 as an extension to the plate circumference. In one or more embodiments the second object holding portion 50 of plate 100 may include a first outwardly extending portion 54 and a second outwardly extending portion 52, with a slight opening, gap or slit 56 residing between these first and second portions 54, 52. The first outwardly extending portion 54 resides along a portion of the perimeter of the plate, while the second outwardly extending portion 52 protrudes out from the first portion 54 and bends in a path substantially along the path of the first portion 54. The second outwardly extending portion 52 is able to move upward or downward for inserting and object therein, and then holding such item within the slit 56.

Figure 10:
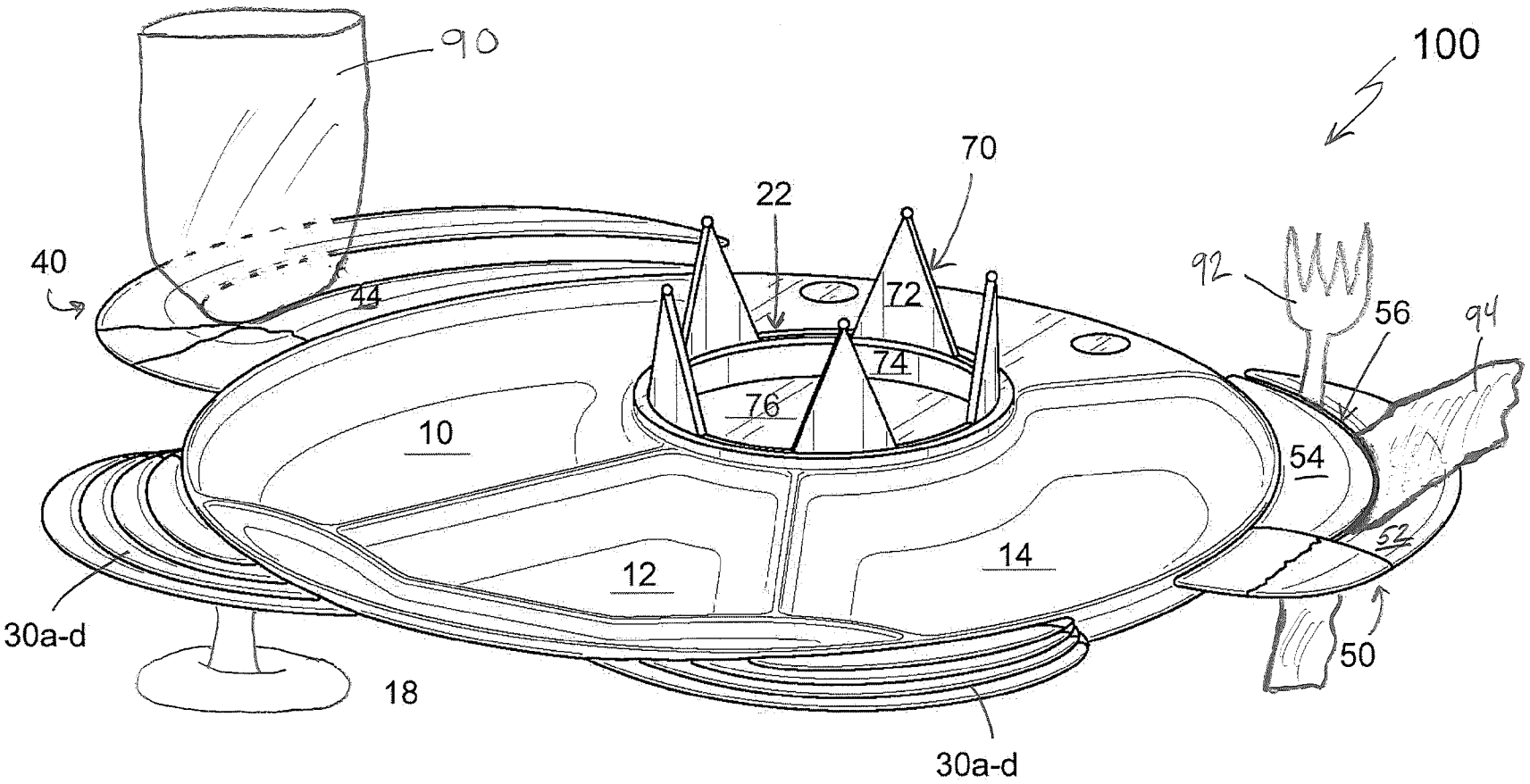
FIG. 10 shows the multipurpose plates of the invention in use.

While not limiting the invention, FIG. 10 shows a plate 100 in accordance with one or more embodiments in use whereby the plate is in the shape of a crab design with the crown insert 70 forming a king crab plate. The first and second object holding portions 40, 50 may be the claws of the crab plate. In use, a cup or stemmed wine glass 90 is inserted in the first claw (i.e., portion 40), preferably until it rests at stop 48, while an eating utensil 92 or napkin 94 or both may be inserted into the slit 56 of the second claw (i.e., portion 50).

The slit 56 is preferably slightly opened to allow the eating utensil and/or napkin to be inserted therein, whereby the second outwardly extending portion 52 moves upward or downward for inserting the utensil and/or napkin therein. In this manner the end-user is allowed to insert a napkin or utensil (fork, knife, spoon, toothpick, etc. or combinations thereof) within such slight opening, gap or slit 56. Once the item is inserted into slit 56, the second object holding portion 50, or at least the second outwardly extending portion 52 thereof, returns to its initial position so as to retain and hold the item therein. Together, the outwardly extending portions 54, 52 hold the eating utensil and/or napkin in position within the slit 56. The gap and flexibility of the outer portion 52 allows the item (e.g., napkin or utensil) to be easily removed. In use, the end user is allowed to hold plate 100 with one hand and simply eat with the other hand, either with or without a utensil. The object holding portions 40, 50 of the plate provide the user with an enhanced, hands-free eating experience since the plate 100 hold glasses, cans, bottles, wine glasses, any known beverage vessel, utensils, napkins, etc. That is, the end user does not need to hold the glass, cup, utensil, napkin, etc. in his hand(s).

The plates 100 of the invention may be used as hors d'oeuvre plates having separate molded compartments 10-14 for separating food items, as well as having a thumb rest 18 on the surface of the plate for gripping such plate. The plates are also provided with a portion 40 for holding stemware, as well as receptacles 20 that can hold cans or cups (e.g., a canned beverage, or glass (with snap-on 5 star crown)). A retaining structure 70 (e.g., a snap on crown for a crab designed plate) is also provided with the plates of the invention, whereby such retaining structures may be permanently affixed to the plate, or removably attached thereto. The plates may be made to have any shape and size. For instance, while not meant to limit the invention, the plate may be substantially circular with a diameter of approximately 11-12 inches. The plates of the invention also include one or more receiving portions 50 for receiving, retaining and holding a napkin, utensil, fork, knife, spoon, toothpick, etc. or combinations thereof. The various plates of the invention allow an end user to hold the plate in one hand and keep the other hand free to perform another task (e.g., eat, drink, hold an object (e.g., phone, digital device, etc. text, write, etc.).

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A multipurpose plate comprising:

a sheet of rigid material comprising:

a centrally located rigid plate portion of the sheet of rigid material having regions for holding food;

first and second tiered rigid hand receiving portions that receive a user's left or right hand for holding the plate, said first and second tiered rigid hand receiving portions residing on a first side of the sheet of rigid material and at opposite ends thereof;

a first outwardly extending portion that extends along a second side of the sheet of rigid material and runs congruent with said second side, said first outwardly extending portion extending out and away from the rigid plate portion along a path of the second side of the sheet of rigid material, the first outwardly extending portion having a first section that does not contact the rigid bottom portion and extends along a path congruent with said second side of the sheet of rigid material;

an opening residing between the first section of the first outwardly extending portion and the second side of the sheet of rigid material, the opening having an open access region for inserting a stemmed drinking vessel into said opening and a resting region, whereby the open access region receives a stern of said stemmed drinking vessel while at said resting region portions of upper surfaces of said first outwardly extending portion and said rigid plate portion receive and hold a bowl portion of said stemmed drinking vessel, said opening having a void region with no rigid material extending along a length of the second side of the sheet of rigid material with the open access region at a first end of said void region and said resting region at a second end of said void region;

a third side of the sheet of rigid material residing opposite said second side;

a second outwardly extending portion at said third side extending out from the rigid plate portion along a path of outer edges of the rigid plate portion;

a slit separating said second outwardly extending portion into first and second separated portions, said second portion comprises a flexible portion of said second outwardly extending portion that is movable in upward and downward directions for receiving and holding an eating related item, the slit having a length less than a length of the second outwardly extending portion;

a recessed receptacle portion on a surface of the rigid plate portion; and a raised retaining structure received in said recessed receptacle portion, whereby together the raised retaining structure and the recessed receptacle portion receive and hold a container.

2. The plate of claim 1 wherein the container is selected from the group consisting of a cup, can, bowl, dish, glass, mug, tray and paper receptacle.

3. The plate of claim 1 wherein the eating related item is selected from the group consisting of a fork, knife, spoon, napkin, toothpick and combinations thereof.

4. The plate of claim 1 further comprising:

wherein the regions for holding food are recessed regions;

a thumb receiving portion adjacent the first and second tiered rigid hand receiving portions for resting a user's thumb;

said first outwardly extending portion that extends out from the rigid plate portion bends in a path substantially along the path of the outer edges of the rigid bottom portion, the first section is adjacent to and connected to the rigid plate portion and is connected to a second section of the first outwardly extending portion faulting a curve therewith, the first section extending a distance away from the second section and along the path of the outer edges of the rigid plate portion to form said opening having a curved shape and a width at said void region with no rigid material between edges of the first and second sections that is able to receive and hold said stemmed drinking vessel;

said second outwardly extending portion extends out from the rigid plate portion at an opposite side location than said first outwardly extending portion, said second separated portion of the second outwardly extending portion being movable in upward, downward and outward directions for receiving and holding said eating related item;

said recessed receptacle portion being centrally located on a surface of the rigid plate portion for receiving said container; and said raised retaining structure being a removable retaining structure that snaps into place within said recessed receptacle portion.

5. The plate of claim 4 wherein the container is selected from the group consisting of a cup, can, bowl, dish, glass, mug, tray and paper receptacle.

6. The plate of claim 5 wherein the eating related item is selected from the group consisting of a fork, knife, spoon, napkin, toothpick and combinations thereof.

7. The plate of claim 1 wherein said raised retaining structure comprises a permanently affixed raised retaining structure for holding the container within the recessed receiving portion.

8. A method of using a multipurpose plate comprising:

providing a plate that includes a sheet of rigid material comprising:

a centrally located rigid plate portion of the sheet of rigid material having regions for holding food;

first and second tiered rigid hand receiving portions that receive a user's left or right hand for holding the plate, said first and second tiered rigid hand receiving portions residing on a first side of the sheet of rigid material and at opposite ends thereof;

a first outwardly extending portion that extends along a second side of the sheet of rigid material and runs congruent with said second side, said first outwardly extending portion extending out and away from the rigid plate portion along a path of the second side of the sheet of rigid material, the first outwardly extending portion having a first section that does not contact the rigid bottom portion and extends along a path congruent with said second side of the sheet of rigid material;

an opening residing between the first section of the first outwardly extending portion and the second side of the sheet of rigid material, the opening having an open access region for inserting a stemmed drinking vessel into said opening and a resting region, whereby the open access region receives a stem of said stemmed drinking vessel while at said resting region portions of upper surfaces of said first outwardly extending portion and said rigid plate portion receive and hold a bowl portion of said stemmed drinking vessel, said opening having a void region with no rigid material extending along a length of the second side of the sheet of rigid material with the open access region at a first end of said void region and said resting region at a second end of said void region;

a third side of the sheet of rigid material residing opposite said second side;

a second outwardly extending portion at said third side extending out from the rigid plate portion along a path of outer edges of the rigid plate portion;

a slit separating said second outwardly extending portion into first and second separated portions, said second portion comprises a flexible portion of said second outwardly extending portion that is movable in upward and downward directions for receiving and holding one or more eating related item, the slit having a length less than a length of the second outwardly extending portion;

a recessed receptacle portion on a surface of the rigid plate portion;

a raised retaining structure for receiving in said recessed receptacle portion, whereby together the raised retaining structure and the recessed receptacle portion receive and hold a container;

a user's hand holding the plate at the first or second tiered rigid hand receiving portions whereby the user's thumb rests in a thumb receiving portion;

the user inserting the stemmed drinking vessel into the opening of the first outwardly extending portion, the stem of the stemmed drinking vessel passing through the open access region, through the void region and stopping at the resting region of the first outwardly extending portion whereby the bowl portion rests on the upper surfaces of said first outwardly extending portion and said rigid plate portion receive; and the user inserting one or more of the one or more eating related items into the slit of the second outwardly extending portion whereby the flexible portion of said second outwardly extending portion moves in at least one of the upward and downward directions to receive and hold one or more of said eating one or more items related within said slit by contact pressure;

whereby the user is able to securely eat food off the plate while the plate holds the stemmed drinking vessel and the one or more eating related items.

9. The method of claim 8 wherein the rigid plate portion is circular and the first outwardly extending portion comprises a crab claw having said opening for holding said stemmed drinking vessel.

10. The method of claim 9 wherein the stemmed drinking vessel is a stemmed wine glass.

11. The method of claim 10 wherein the container is selected from the group consisting of a cup, can, bowl, dish, glass, mug, tray and paper receptacle.

12. The method of claim 11 wherein the one or more eating related item is selected from the group consisting of a fork, knife, spoon, napkin, toothpick and combinations thereof.

13. The method of claim 12 further including inserting numerous eating related items into the slit of the second outwardly extending portion.

14. The method of claim 8 further including removing the one or more eating related items from the slit for use, and reinserting said one or more eating related items into the slit all while holding said plate.

15. The method of claim 8 further including inserting the container within the raised retaining structure and the recessed receptacle portion and being held therein.

16. The method of claim 15 wherein the container is selected from the group consisting of a cup, can, bowl, dish, glass, mug, tray and paper receptacle.

17. The method of claim 15 wherein the raised retaining structure is adjoined to and securely affixed within the recessed receiving portion.

18. The method of claim 15 wherein the raised retaining structure has upwardly extending side walls that do not extend past the width of the recessed receiving portion, the raised retaining structure is snap fit into the recessed receiving portion.

19. The method of claim 15 wherein the plate has a shape of a crab and the inserted raised retaining structure has a crown shape to provide a king crab plate.

* * * * *